US011280578B1

(12) United States Patent
Moran et al.

(10) Patent No.: US 11,280,578 B1
(45) Date of Patent: Mar. 22, 2022

(54) SELF-DEFENSE DEVICE

(71) Applicants: Robert J. Moran, Belmont, MA (US); Marc Karl Losee, Woodstock, GA (US)

(72) Inventors: Robert J. Moran, Belmont, MA (US); Marc Karl Losee, Woodstock, GA (US)

( * ) Notice: Subject to any disclaimer, the term of this patent is extended or adjusted under 35 U.S.C. 154(b) by 556 days.

(21) Appl. No.: 15/266,565

(22) Filed: Sep. 15, 2016

Related U.S. Application Data

(60) Provisional application No. 62/283,874, filed on Sep. 15, 2015.

(51) Int. Cl.
*F41B 15/00* (2006.01)

(52) U.S. Cl.
CPC ..... *F41B 15/00* (2013.01)

(58) Field of Classification Search
CPC ..... F41B 15/00; A45B 3/02
See application file for complete search history.

(56) References Cited

U.S. PATENT DOCUMENTS 2,457,195 A * 12/1948 Bagnall, Jr. ..... A44B 15/00 24/3.13
4,506,889 A * 3/1985 Lewis ..... F41B 15/00 463/47.4
5,457,976 A * 10/1995 Stillwagon ..... A44B 15/002 24/3.6
5,809,814 A * 9/1998 Cons ..... A44B 15/00 40/330
6,161,314 A * 12/2000 Kamrin ..... A43B 3/30 24/115 H
D558,446 S * 1/2008 Moran ..... D3/208
2005/0262904 A1* 12/2005 Ling ..... E05B 67/003 70/49
2012/0262909 A1* 10/2012 Campman ..... F21L 4/02 362/102

(Continued)

*Primary Examiner* — Alvin A Hunter
*Assistant Examiner* — Christopher Glenn
(74) *Attorney, Agent, or Firm* — Glen E. Schumann; Moss & Barnett

(57) ABSTRACT

A hand weapon that appears to be an innocuous key carrying device is employed for self-defense. In a first preferred embodiment, the device includes a hollow handle having flexible cordage, typically a double cord, that passes through it to which a number of keys or other weighted objects are affixed via an attachment mechanism, usually a split-ring or similar mechanism. A spring-loaded plunger mechanism extending radially through a cross-section of the hollow handle pinches a portion of the flexible cordage in the interior of the hollow handle to hold it in position. A first position is where the attachment mechanism abuts a first end of the hollow handle. If an attacker threatens, the user depresses the spring-loaded plunger mechanism while slinging the first end with weighted objects affixed, typically keys, toward the attacker using a slashing movement. The weight of the keys aids in rapidly deploying the flexible cordage to a second position, which reaches full extension when the stop mechanism abuts the second end of the hollow handle. This action permits the keys to be hurled to and fro at an attacker. This self-defense device may be used for blocking and counterattacking the attacker.

23 Claims, 9 Drawing Sheets

(56) References Cited

U.S. PATENT DOCUMENTS

| | | | | |
|---|---|---|---|---|
| 2013/0145994 | A1* | 6/2013 | Lash | A01K 27/009<br>119/796 |
| 2015/0096123 | A1* | 4/2015 | Whaley | A47C 21/022<br>5/496 |

* cited by examiner

SELF-DEFENSE DEVICE

CROSS REFERENCE TO RELATED APPLICATION

This application claims priority to U.S. Provisional Application 62/283,874 filed on Sep. 15, 2015, which is hereby incorporated by reference in its entirety.

FIELD OF INVENTION

The field of the invention relates generally to hand weapons, and has particular reference to a novel self-defense weapon that can be carried in a purse or pocket and has the appearance of a harmless key carrying device.

BACKGROUND OF THE INVENTION

Heretofore, a number of hand weapons have been developed, primarily for self-defense that are not firearms or knives or dispensers of chemicals. Many of these non-firearm/knife weapons have their origin in the Far East and utilize chains or telescoping sticks or rods. One such instrument that employs a chain is a manriki-gusari while an instrument that utilizes telescoping members is a nunchaku. The well-known night and riot sticks carried by law enforcement officers also fall within this category of weapons.

For the average individual who wants only to be able to defend himself, the weapons mentioned above have disadvantages. A stick type weapon, for example, is not easily concealed and since it appears to be a weapon it can provoke a counter-threat and the danger of an escalating confrontation. A chain type weapon such as the manriki-gusari may, on the other hand, be innocent looking but it has the disadvantage of being heavy and cumbersome. Thus, a manriki-gusari typically comprises a relatively heavy eighteen to twenty-four inch chain with a dozen or so brass keys on each end and is not something the average person wishes to carry in a pants pocket or purse.

SUMMARY OF INVENTION

A hand weapon that appears to be an innocuous key carrying device is used for self-defense. In a first preferred embodiment, the device includes a hollow handle having typically a double cord, that passes through it to which a number of keys or other weighted objects are affixed via an attachment mechanism, usually a split-ring or similar mechanism. A spring-loaded plunger mechanism extending radially through a cross-section of the hollow handle pinches a portion of the flexible cordage in the interior of the hollow handle to hold it in position. A first position is where the attachment mechanism abuts a first end of the hollow handle.

If an attacker threatens, the user depresses the spring-loaded plunger mechanism while slinging the first end with weighted objects affixed, typically keys, toward the attacker using a slashing movement. The weight of the keys aids in rapidly deploying the flexible cordage to a second position, which reaches full extension when the stop mechanism abuts the second end of the hollow handle. This action permits the keys to be hurled to and fro at an attacker. This self-defense device may be used for blocking and counterattacking the attacker.

In a second preferred embodiment of the present invention, the flexible cordage is replaced with a rigid rod, but otherwise functions in a manner similar to that of the first preferred embodiment.

Lights, sound and a repellent spray can also be added to the device, so that upon deployment of the rod or flexible cordage to the second position, the attacker will hear a frightening noise, be subjected to the repellent and/or see lights that mimic a Taser strike, yielding an opportunity for the would-be victim to escape from the attacker.

This and other objects, features, and/or advantages may accrue.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION OF THE INVENTION

Particular embodiments of the present invention will now be described in greater detail with reference to the figures.

Figure 1A:
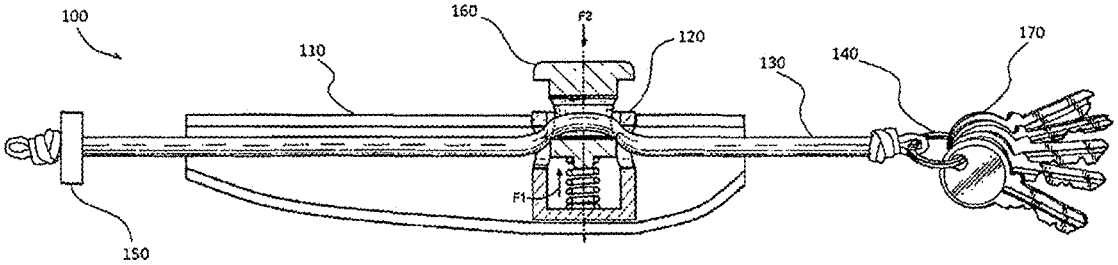
FIG. 1*a* shows a cut-away view of a first embodiment of the self-defense device with the release mechanism holding the flexible cordage in place according to the subject disclosure.

FIG. 1*a* illustrates, in a cut-away view, the first embodiment of the self-defense device 100. The first embodiment of the self-defense device 100 includes a hollow handle 110 for gripping the device, as well as providing a conduit for movement of the flexible cordage 130. Also included is a release mechanism 120 that extends radially through a cross section of the hollow handle 110. The release mechanism 120 includes a spring-loaded plunger 160. At a first end of the self-defense device 100, an attachment mechanism 140 is attached to a first end of the flexible cordage 130. Weighted objects 170 are attached to the attachment mechanism 140. Additionally, a stop mechanism 150 is attached to a second end of the flexible cordage 130 at a second end of the self-defense device 100.

The hollow handle 110 functions as the hand grip for the self-defense device 100 and is also a conduit for the flexible cordage 130. The hollow handle 110 is any shape hollow tube such as round, square, octagonal, n-sided or custom shape to fit in and be gripped by a hand, and is made from any type of rigid material such as wood, bamboo, metal, rubber, plastic, ABS, nylon or other similar rigid material or combination of materials. The hollow handle is typically approximately 4 to 6 inches in length and typically approximately 1 inch or less in cross sectional dimension.

The flexible cordage 130 is typically a double cord made from a very flexible material such as natural fiber as used in string, twine and rope, also nylon, plastic as used in rope and cords, as well as metal as used in cabling. All of these materials and similar other materials that exhibit the property of flexibility lend themselves to being used as indicated in the subject disclosure. The flexible cordage 130 is typically 3 to 4 times the length of the hollow handle 110, approximately 12 to 24 inches.

The release mechanism 120 includes a spring loaded plunger 160. When there is no force on the spring-loaded plunger 160, F2 is zero, the spring force F1 raises the spring-loaded plunger 160 to the point where the flexible cordage 130 that is disposed longitudinally through the hollow handle 110 and the opening and passage of the release mechanism 120 is pinched by the release mechanism 120 and held in place due to the misalignment of the opening and passage as illustrated in FIG. 1*a*. More detail on this configuration will be discussed in reference to FIG. 2*a*.

Figure 1B:
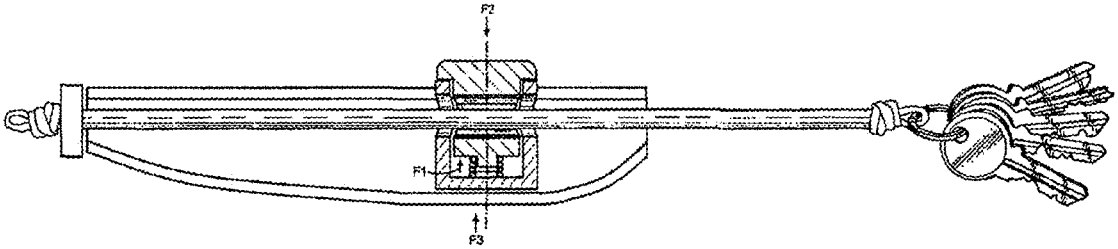
FIG. 1*b* shows a cut-away view of a first embodiment of the self-defense device with the release mechanism spring-loaded plunger engaged allowing the flexible cordage to move freely according to the subject disclosure.

When a force F2 is applied to the spring-loaded plunger 160 of the release mechanism 120 along with opposing support force F3, the passages in the release mechanism 120 and spring-loaded plunger 160 align allowing the flexible cordage 130 to move freely within the hollow handle 110 and the release mechanism 120 as illustrated in FIG. 1*b*. More detail on this configuration will be discussed in reference to FIG. 2*b*. This freedom of movement in turn allows the self-defense device 100 to be used according to the subject disclosure.

The attachment mechanism 140 is affixed to a first end of the flexible cordage 130 adjacent to the first end of the hollow handle 110. The attachment mechanism 140 can be a split-ring, a threaded quick link, a spring snap, a snap bolt, a slide bolt spring snap or any similar mechanism that can be attracted to a cord and easily attach and hold multiple weighted objects.

One or more weighted objects 170 are affixed to the attachment mechanism 140. The weighted objects 170 are typically keys, but can also be key fobs, or even fishing weights; any object that can attach to a split-ring, a threaded quick link, a spring snap, a snap bolt, a slide bolt spring snap or any similar mechanism. The weighted objects 170 are used to assist in the deployment of the flexible cordage 130 when the spring-loaded plunger 160 of the release mechanism 120 is depressed. Once the flexible cordage 130 is deployed to its maximum extent, the self-defense device 100 can be used according to the subject disclosure.

The stop mechanism 150 is affixed to the second end of the flexible cordage 130 adjacent the second end of the hollow handle 110. The stop mechanism 150 can be a knot in the flexible cordage 130 that is large enough to prevent itself from traveling through the hollow handle 110. It can also be a washer, a disk or a dowel pin affixed to the flexible cordage 130 that is of a physical dimension such that when the spring-loaded plunger 160 of the release mechanism 120 is depressed, the flexible cordage 130 will travel through the hollow handle 110 until the washer, a disk or a dowel pin abuts the second end of the hollow handle 110, preventing further travel of the flexible cordage 130 through the hollow handle 110 as illustrated in FIG. 1*b*.

Figure 2A:
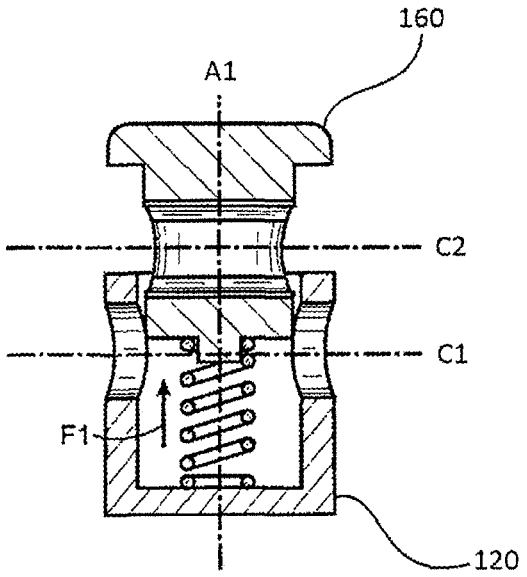
FIG. 2*a* shows a cut-away view of a first embodiment of the release mechanism with the spring-loaded plunger in the rest position.

FIG. 2*a* shows the release mechanism 120 and spring-loaded plunger 160 in the state where there is no downward force on the plunger along axis A1 to oppose the spring force F1. As is illustrated, the centerline C1 of the passage opening of the release mechanism 120 is not aligned with the centerline C2 of the passage opening of the spring-loaded plunger 160. This is the mechanism that pinches the flexible cordage 130 when such cordage is disposed longitudinally through the hollow handle 110 and the opening and passage of the release mechanism 120.

Figure 2B:
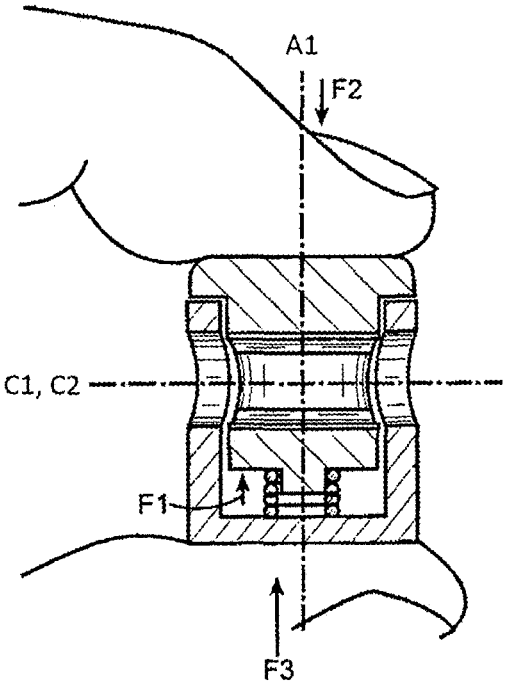
FIG. 2*b* shows a cut-away view of a first embodiment of the release mechanism with the spring-loaded plunger in the fully depressed position.

FIG. 2*b* shows the release mechanism 120 and spring-loaded plunger 160 in the state where there is downward force F2 on the plunger along axis A1 to oppose the spring force F1; force F3 is merely a support force generated by holding the self-defense device 100 in the hand while depressing the spring-loaded plunger 160. As is illustrated, the centerline C1 of the passage opening of the release mechanism 120 is aligned with the centerline C2 of the passage opening of the spring-loaded plunger 160. This is the mechanism that allows freedom of movement of the flexible cordage 130 when such cordage is disposed longitudinally through the hollow handle 110 and the opening and passage of the release mechanism 120.

Figure 3:
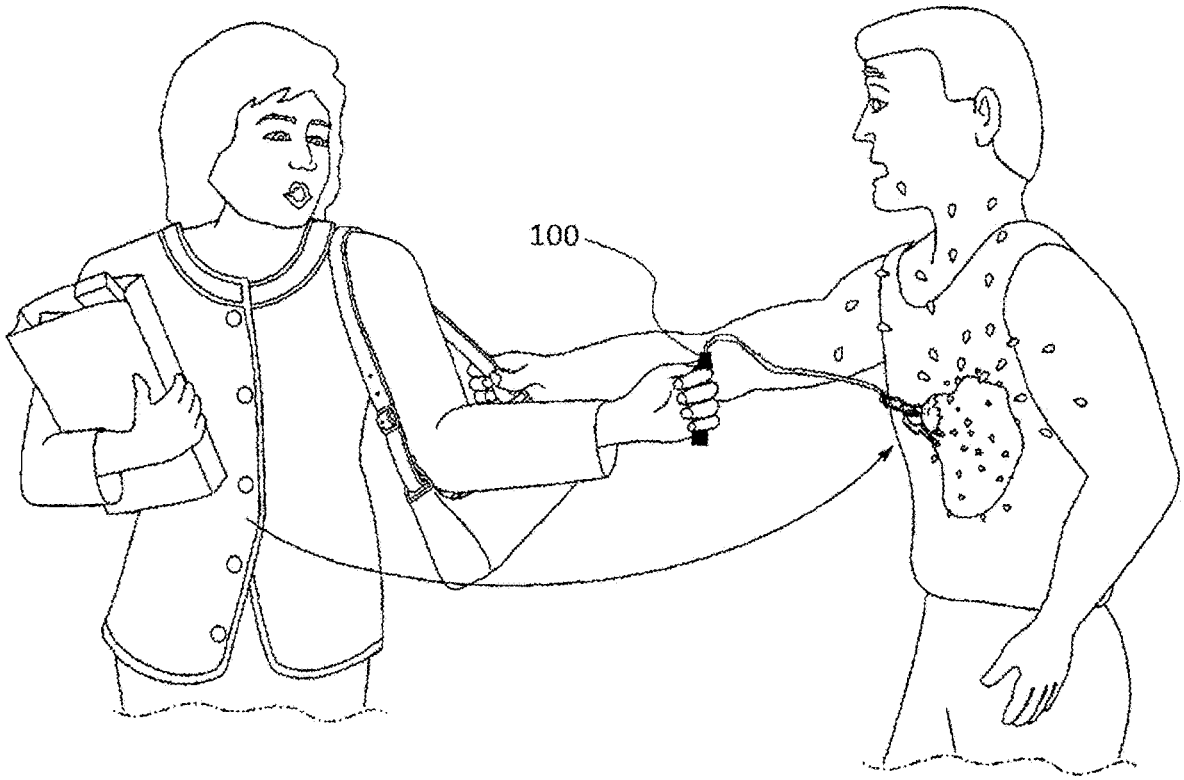
FIG. 3 illustrates the technique used to fend off an attacker with the self-defense device according to the subject disclosure.

FIG. 3 illustrates the method used to employ the self-defense device 100 to protect one from and repel an attacker. This is accomplished by holding the self-defense devise 100 in the hand in a first position wherein the attachment mechanism 140 with weighted objects 170 affixed is abutting the first end of the hollow handle 110. A force is applied to a spring-loaded plunger 160 in the release mechanism 120 to release the flexible cordage 130 and simultaneously slinging the self-defense devise 100 with the attachment mechanism 140 with the weighted objects 170 affixed toward an attacker wherein the weight of the weighted objects 170 aids in rapidly deploying the flexible cordage 130 through the hollow handle 110.

Upon the flexible cordage 130 reaching full extension of the self-defense device 100 to a second position where the stop mechanism 150 abuts the second end of the hollow handle 110, the weighted objects 170 can now be employed to block and counter-attack an attacker by using the technique of hurling and slashing the weighted objects 170 to and fro toward the attacker.

In another exemplary embodiment, when a force is applied to a spring-loaded plunger 160 in the release mechanism 120 to release the flexible cordage 130 of the self-defense device 100, an additional function is invoked. Upon depressing the spring-loaded plunger 160, a sound device located inside the hollow handle 110 emits a piercing shrill tone or sound. The shrill tone is designed to have the effect of startling, surprising, scaring and causing pain to the ears of an attacker, yielding an opportunity for the would-be victim to escape from the attacker.

In yet another exemplary embodiment, when a force is applied to a spring-loaded plunger 160 in the release mechanism 120 to release the flexible cordage 130 of the self-defense device 100, an additional function is invoked. Upon depressing the spring-loaded plunger 160, a dispensing device located inside the hollow handle 110 deploys mace or pepper spray in the direction of the first end of the hollow handle 110 which is pointed in the direction of an attacker.

The mace or pepper spray is designed to have the effect of startling, surprising, scaring and causing pain to the eyes and nasal passages of an attacker, yielding an opportunity for the would-be victim to escape from the attacker.

In yet another exemplary embodiment, when a force is applied to a spring-loaded plunger 160 in the release mechanism 120 to release the flexible cordage 130 of the self-defense device 100, an additional function is invoked. Upon depressing the spring-loaded plunger 160, a light emitting device located inside the hollow handle 110 emits a light array in the direction of the first end of the hollow handle 110 which is pointed in the direction of an attacker. The light is designed to have the effect of causing the attacker to believe he or she is being subjected to a Taser electroshock, yielding an opportunity for the would-be victim to escape from the attacker.

Figure 6:
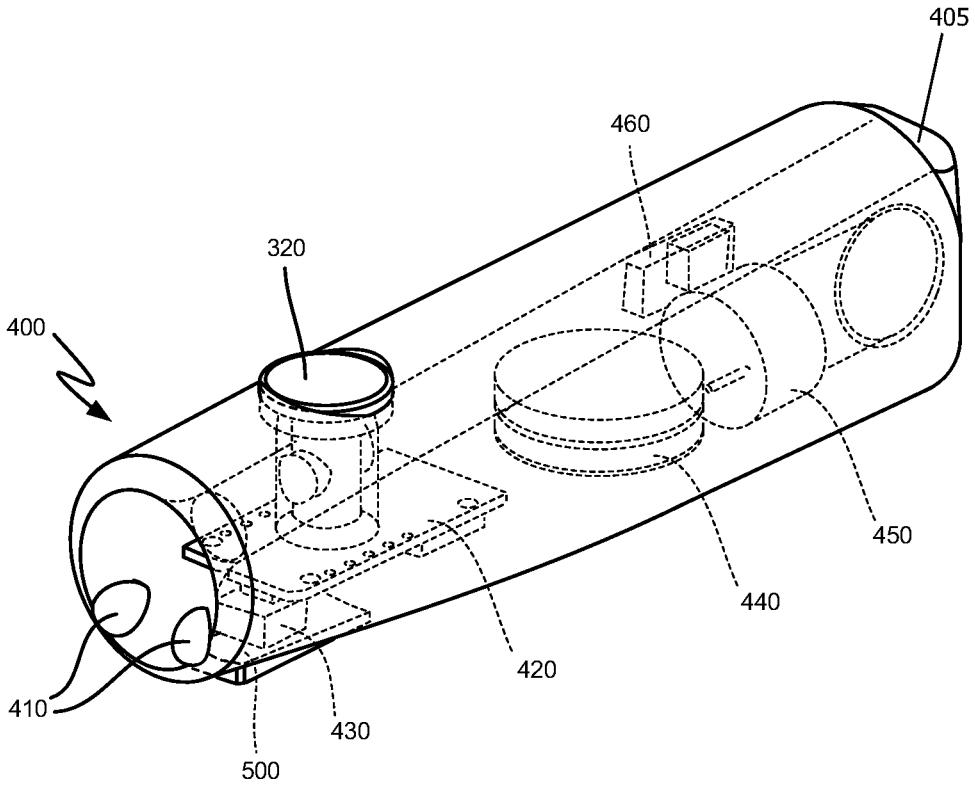
FIG. 6 is a perspective view of the handle of a second embodiment of the present invention, shown with the inner workings of the device.
Figure 7:
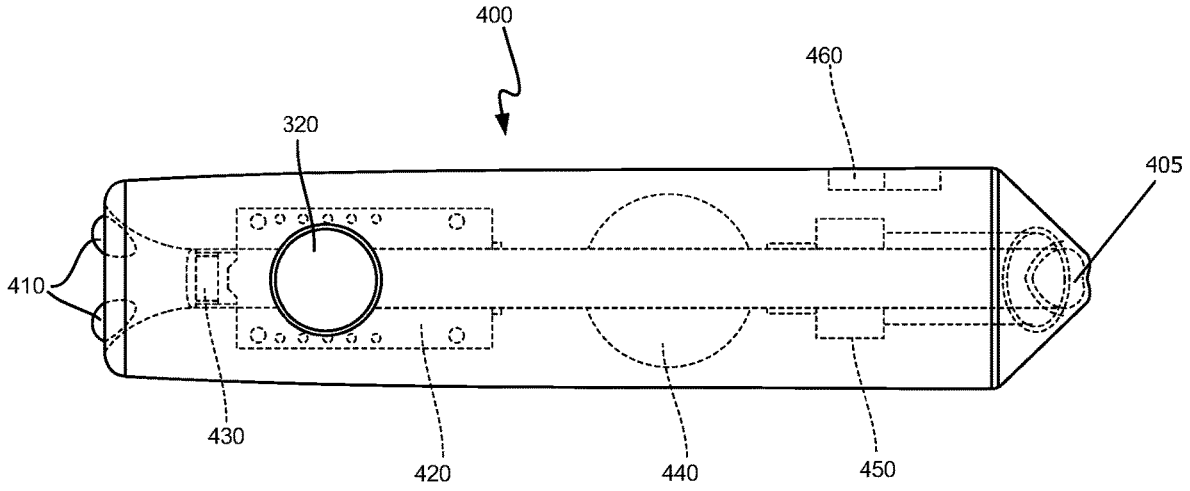
FIG. 7 is a top view of the handle of a second embodiment of the present invention, shown with the inner workings of the device.
Figure 8:
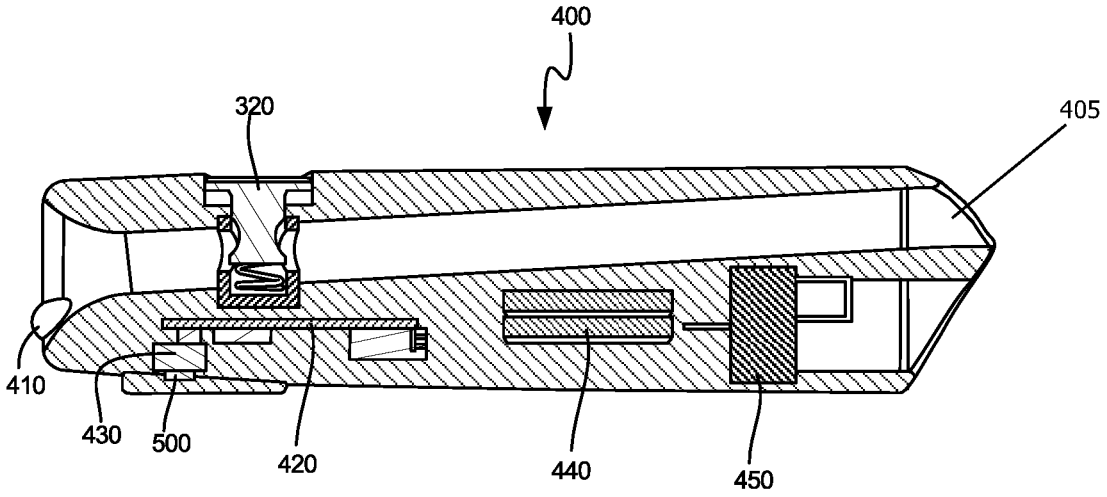
FIG. 8 is a side view of the handle of a second embodiment of the present invention, shown with the inner workings of the device.
Figure 9:
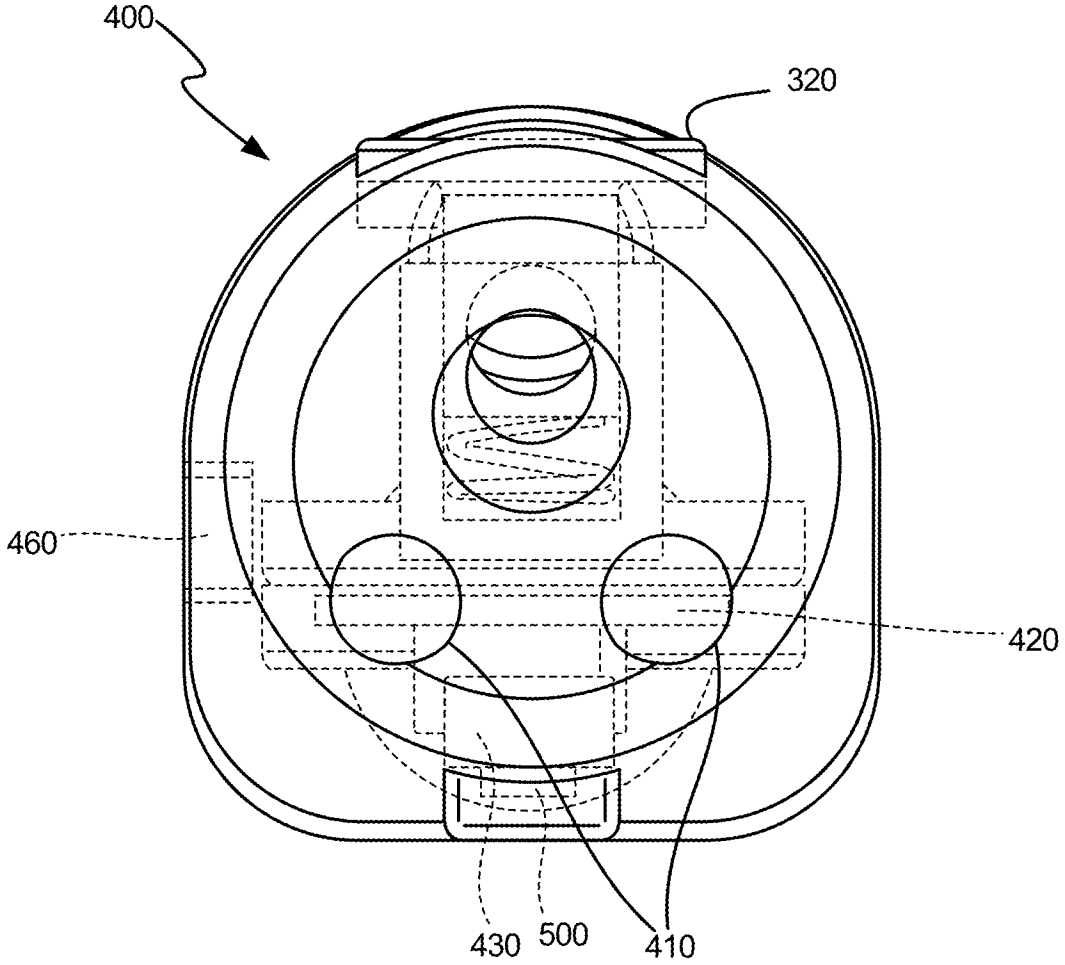
FIG. 9 is a front view of the handle of a second embodiment of the present invention, shown with the inner workings of the device.

In yet another exemplary embodiment, the sound/light/repellent feature can be triggered independently from the depression of the release mechanism by depressing activation trigger or button 500 under switch 430 (see FIG. 6).

Figure 4:
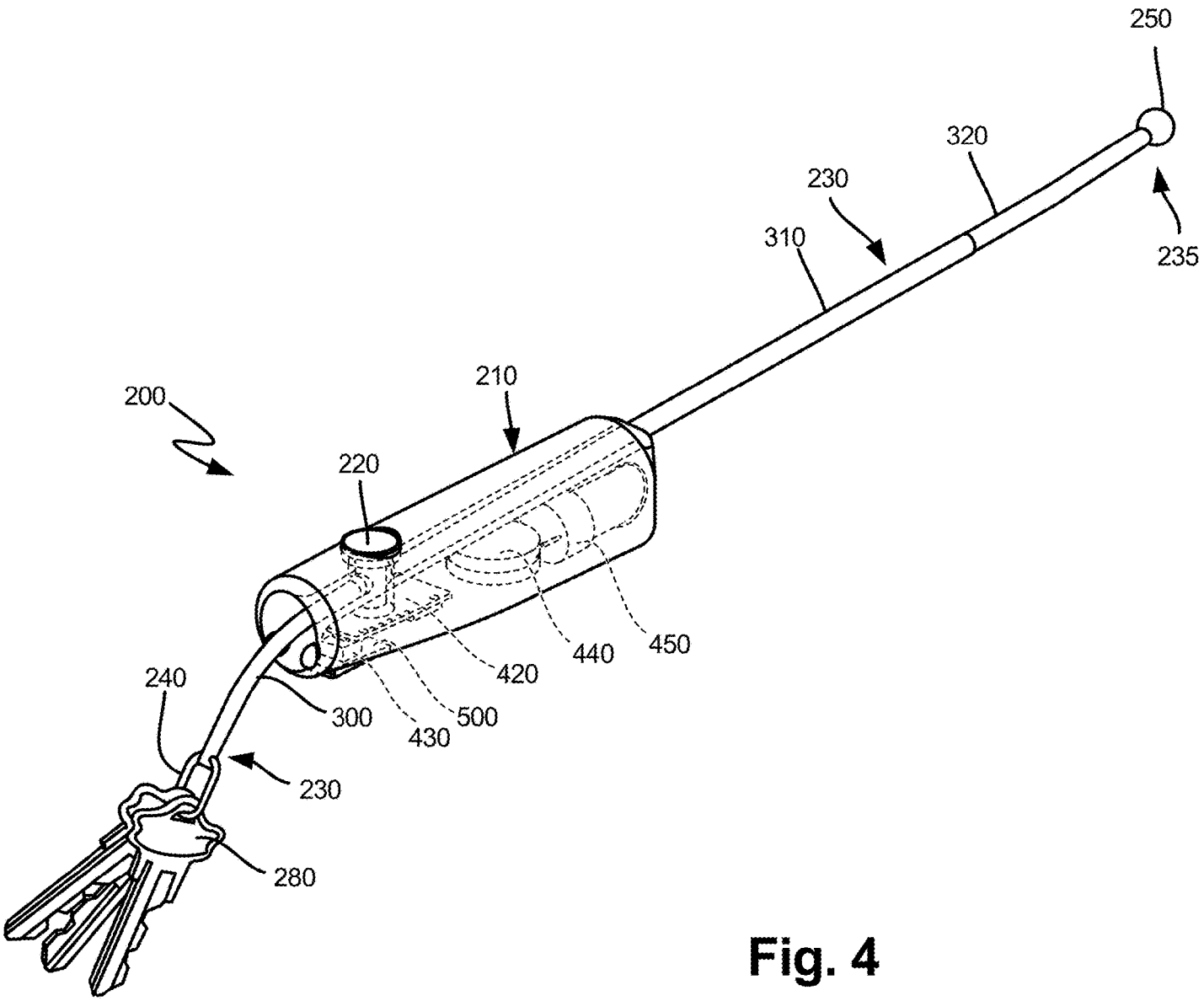
FIG. 4 is a perspective view of a second embodiment of the present invention, shown with the inner workings of the device, with the rod in its retracted or first position.
Figure 5:
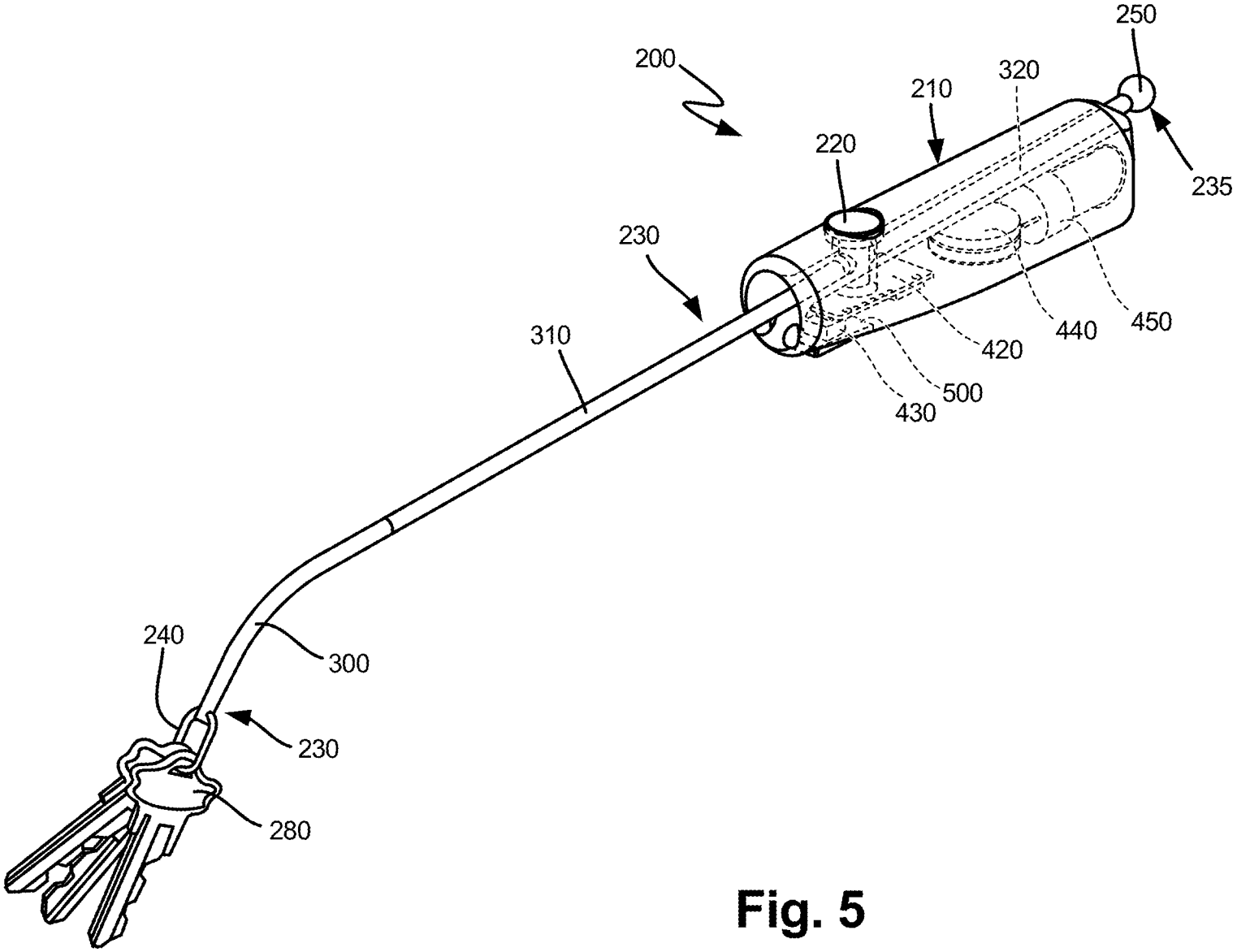
FIG. 5 is a perspective view of a second embodiment of the present invention, shown with the inner workings of the device, with the rod in its extended or second position.

FIG. 4 illustrates a perspective view of a second embodiment of the self-defense device 200 with a handle 210 showing the inner workings of the device. Self-defense device 200 includes a hollow handle 210 for gripping the device, as well as providing a conduit for movement of the rigid rod 230. Also included is a release mechanism 220 that extends radially through a cross section of the hollow handle 210. The release mechanism 220 functions much as the release mechanism 120 of the first embodiment of the self-defense device.

At a first end of the self-defense device 200, an attachment mechanism 240 is attached to a first end of the rigid rod 230. Weighted objects 280 are attached to the attachment mechanism 240. Additionally, a stop mechanism 250 is formed at a second end 235 of the rigid rod 230 at a second end of the self-defense device 200.

The hollow handle 210 functions as the hand grip for the self-defense device 200 and is also a conduit for the rigid rod 230. Similar to the first embodiment of the present invention, the hollow handle 210 is any shaped hollow tube with a preferred length of 4 to 6 inches and typically approximately 1 inch or less in cross sectional dimension.

The rigid rod 230 may be made of any durable material and polish that allows the rod to move freely though the release mechanism when released by the release mechanism. The rigid rod 230 is typically 3 to 4 times the length of the hollow handle 210, approximately 12 to 24 inches.

In one embodiment, the rod includes three separate sections that screw or fasten together in end-to-end relation. The first section 300 is attached to the attachment mechanism 240 and may have some curvature to assist in the rod deployment process and for better orientation when striking an attacker. A second section 310 is substantially straight to assure proper deployment through the release mechanism. A third section 320 defines the stop 250 to limit movement of the rod through the release mechanism. The three sections are also designed to facilitate assembly of the self-defense device.

The release mechanism 220 is and functions similar to the release mechanism 120 of the first embodiment of the self-defense device.

The attachment mechanism 240 is and functions similar to the attachment mechanism 140 of the first embodiment of the self-defense device.

The weighted objects 280 are and function similar to the weighted objects 170 of the first embodiment of the self-defense device.

The stop mechanism 250 is formed at the second end 235 of the rigid rod 230 and functions in the same manner as the stop mechanism 150 of the first embodiment of the self-defense device.

The second embodiment of the self-defense device deploys in a manner similar to the deployment of the first embodiment of the self-defense device.

FIGS. 6-9 illustrate the sound, light and repellent functionality of the self-defense device, all of which are contained within the handle 210.

At the front end 400 of the handle 230 are lights 410 (and/or repellent emitting portals, not shown). Release mechanism 320 is mounted on a flexibly mounted circuit board 420. When the release mechanism is depressed to deploy the rigid rod, the circuit board 420 flexes to engage a switch 430 (or completes an electrical circuit) to trigger emission of the light, repellent and/or sound. When the release mechanism is depressed to deploy the rigid rod, the circuit board 420 flexes to engage a switch 430 (or completes and electrical circuit) to trigger emission of the light, repellent and/or sound.

Batteries 440 power the speaker 450 at a second end 405 of the handle 210.

An "on and off" switch 460 can also be provided for the device.

The sound generated by the device can be of any type having the effect of startling, surprising, scaring and causing pain to the ears of an attacker, yielding an opportunity for the would-be victim to escape from the attacker. In one preferred embodiment, the sound is that of a Taser to make the attacker believe he or she is receiving an electroshock.

The repellent may be of any type known to discourage or debilitate a would be attacker The light may also be of any type known to temporarily blind or impair the vision of the attacker. In one preferred embodiment, the light simulates the light generated by a Taser to make the attacker believe he or she is receiving an electroshock.

Although specific features of various embodiments of the invention may be shown in some drawings and not in others, this is for convenience only. In accordance with the principles of the invention, any feature of a drawing may be referenced and/or claimed in combination with any feature of any other drawing.

The illustrations and examples provided herein are for explanatory purposes and are not intended to limit the scope of the appended claims. It will be recognized by those skilled in the art that changes or modifications may be made to the above described embodiment without departing from the broad inventive concepts of this subject disclosure. It is understood therefore that this subject disclosure is not limited to the particular embodiment which is described, but is intended to cover all modifications and changes within the scope and spirit of this subject disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A self-defense device for use in self-defense, the self-defense device comprising:

a hollow handle having a first end and a second end;

a release mechanism operably mounted to the hollow handle, wherein the release mechanism has an opening formed therein and wherein the release mechanism is positionable in a holding configuration and a movement configuration;

a flexible cordage having a first end and a second end, wherein the flexible cordage passes longitudinally through the hollow handle, wherein the flexible cordage passes through the opening in the release mechanism, wherein the flexible cordage is slidable through the hollow handle when the release mechanism is in the movement configuration and wherein the flexible cordage is prevented from sliding through the hollow handle when the release mechanism is in the holding configuration;

an attachment mechanism affixed to the first end of the flexible cordage, wherein the hollow handle prevents the attachment mechanism from traveling through the hollow handle; and a stop mechanism affixed to the second end of the flexible cordage, wherein the hollow handle prevents the stop mechanism from traveling through the hollow handle, wherein the self-defense device is positionable in a first position and a second position and wherein when the self-defense device is in the second position, the stop mechanism abuts the second end of the hollow handle.

2. The self-defense device of claim 1, wherein the release mechanism produces the opening for the flexible cordage to pass through freely when a force is applied to depress a spring-loaded plunger of the release mechanism and minimizes the opening when the force is released from the spring-loaded plunger to pinch and hold the flexible cordage in place.

3. The self-defense device of claim 1, wherein the hollow handle has a length and wherein the flexible cordage is at least the length of the hollow handle.

4. The self-defense device of claim 3, wherein the flexible cordage is a double cord and wherein the double cord is a material selected from the group consisting essentially of nylon, plastic, natural fiber and metal wire.

5. The self-defense device of claim 1, wherein the attachment mechanism is selected from the group consisting essentially of a split-ring, a threaded quick link, a spring snap, a snap bolt and a slide bolt spring snap.

6. The self-defense device of claim 1, wherein at least one weighted object is affixed to the attachment mechanism and wherein the at least one weighted object is selected from the group consisting essentially of keys, key fobs and fishing weights.

7. The self-defense device of claim 1, wherein the stop mechanism is a knot in the flexible cordage; wherein the knot abuts the second end of the hollow handle when the self-defense device is in the second position to prevent further travel of the flexible cordage through the hollow handle.

8. The self-defense device of claim 1, wherein the stop mechanism is selected from the group consisting essentially of a knot, a washer, a disk and a dowel pin.

9. The self-defense device of claim 1 wherein the self-defense device further comprises a sound mechanism for emitting a piercing or startling sound when a force is applied to depress a spring-loaded plunger of the release mechanism.

10. The self-defense device of claim 1 wherein the self-defense device further comprises a light mechanism for emitting a blinding or startling light when a force is applied to depress a spring-loaded plunger of the release mechanism.

11. The self-defense device of claim 1 wherein the self-defense device further comprises a repellent mechanism for emitting a repellent when a force is applied to depress a spring-loaded plunger of the release mechanism.

12. The self-defense device of claim 1 wherein the self-defense device further comprises a mechanism for emitting one or more of a repellent, startling light and startling sound when a force is applied to depress a spring-loaded plunger of the release mechanism.

13. A self-defense device for use in self-defense, the device comprising:

a hollow handle having a first end and a second end;

a release mechanism extending radially through a cross section of the hollow handle, wherein the release mechanism has an opening formed therein and wherein the release mechanism is positionable in a holding configuration and a movement configuration;

a rigid rod having a first end and a second end, wherein the rigid rod passes longitudinally through the hollow handle longitudinally, wherein the rigid rod passes through the opening in the release mechanism, wherein the rigid rod is slidable through the hollow handle when the release mechanism is in the movement configuration and wherein the rigid rod is prevented from sliding through the hollow handle when the release mechanism is in the holding configuration;

an attachment mechanism affixed to the first end of the rigid rod adjacent a first end of the hollow handle, wherein the hollow handle prevents the attachment mechanism from traveling through the hollow handle; and a stop mechanism affixed to the second end of the rigid rod adjacent a second end of the hollow handle, wherein the hollow handle prevents the stop mechanism from traveling through the hollow handle, wherein the self-defense device is positionable in a first position and a second position and wherein when the self-defense device is in the second position, the stop mechanism abuts the second end of the hollow handle.

14. The self-defense device of claim 13, wherein the release mechanism produces the opening for the rigid rod to pass through freely when a force is applied to depress a spring-loaded plunger of the release mechanism and minimizes the opening when the force is released from the spring-loaded plunger to pinch and hold the rigid rod in place.

15. The self-defense device of claim 13, wherein the hollow handle has a length and wherein the rigid rod is at least the length of the hollow handle.

16. The self-defense device of claim 15, wherein the rigid rod is a material selected from the group consisting essentially of nylon, plastic, natural fiber and metal.

17. The self-defense device of claim 13, wherein the attachment mechanism is selected from the group consisting essentially of a split-ring, a threaded quick link, a spring snap, a snap bolt and a slide bolt spring snap.

18. The self-defense device of claim 13, wherein at least one weighted object is affixed to the attachment mechanism; wherein the at least one weighted object is selected from the group consisting essentially of keys, key fobs and fishing weights.

19. The self-defense device of claim 13, wherein the stop mechanism is a section of the rigid rod that is larger than the opening defined by the release mechanism to prevent further travel of the rigid rod through the handle when the self-defense device is in the second position.

20. The self-defense device of claim 13 further including a sound mechanism for emitting a piercing or startling sound when a force is applied to depress a spring-loaded plunger of the release mechanism.

21. The self-defense device of claim 13 further including a light mechanism for emitting a blinding or startling light when a force is applied to depress a spring-loaded plunger of the release mechanism.

22. The self-defense device of claim 13 further including a repellent mechanism for emitting a repellent when a force is applied to depress a spring-loaded plunger of the release mechanism.

23. The self-defense device of claim 13 further including a mechanism for emitting one or more of a repellent, startling light and startling sound when a force is applied to depress a spring-loaded plunger of the release mechanism.

* * * * *